US012408694B2

(12) United States Patent
Song et al.

(10) Patent No.: US 12,408,694 B2
(45) Date of Patent: Sep. 9, 2025

(54) AEROSOL GENERATING APPARATUS

(71) Applicant: KT&G CORPORATION, Daejeon (KR)

(72) Inventors: Ho Rim Song, Daejeon (KR); In Beom Song, Daejeon (KR); Ji Seob Woo, Daejeon (KR); Chang Gook Lee, Daejeon (KR); Kyung Bin Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 18/008,841

(22) PCT Filed: Oct. 17, 2022

(86) PCT No.: PCT/KR2022/015719
§ 371 (c)(1),
(2) Date: Dec. 7, 2022

(87) PCT Pub. No.: WO2023/075249
PCT Pub. Date: May 4, 2023

(65) Prior Publication Data

US 2024/0225082 A1 Jul. 11, 2024

(30) Foreign Application Priority Data

Oct. 28, 2021 (KR) ..... 10-2021-0145686

(51) Int. Cl.
*A24B 15/24* (2006.01)
*A24F 40/46* (2020.01)
*A24F 40/57* (2020.01)

(52) U.S. Cl.
CPC ..... *A24B 15/243* (2013.01); *A24F 40/46* (2020.01); *A24F 40/57* (2020.01)

(58) Field of Classification Search
None
See application file for complete search history.

(56) References Cited

U.S. PATENT DOCUMENTS 5,301,664 A * 4/1994 Sievers ..... B01F 23/09 222/207
8,887,737 B2 11/2014 Howell et al.
(Continued)

FOREIGN PATENT DOCUMENTS

EP 3 711 594 A1 9/2020
KR 10-2008-0031904 A 4/2008
(Continued)

OTHER PUBLICATIONS

International Search Report dated Jan. 25, 2023 in International Application No. PCT/KR2022/015719.
(Continued)

*Primary Examiner* — Michael H. Wilson
*Assistant Examiner* — Daniel Edward Vakili
(74) *Attorney, Agent, or Firm* — Sughrue Mion, PLLC

(57) ABSTRACT

Provided is an aerosol generating apparatus, including: a supercritical extraction unit that includes at least one of tobacco and aromatic plant as a raw material, and extracts an extraction component from the raw material by a supercritical fluid; a collection unit that collects the extraction component discharged from the supercritical extraction unit as a collection material; an inlet part that is disposed between the supercritical extraction unit and the collection unit and serves as a path through which the extraction component is introduced from the supercritical extraction unit into the collection unit; a heating unit that heats at least one of the supercritical extraction unit and the collection unit, and a
(Continued)

body part in which the supercritical extraction unit, the collection unit, the inlet part, and the heating unit are disposed.

13 Claims, 3 Drawing Sheets

(56) References Cited

U.S. PATENT DOCUMENTS

| | | | |
|---|---|---|---|
| 2007/0023058 | A1 | 2/2007 | Howell et al. |
| 2019/0046741 | A1 | 2/2019 | Lord et al. |
| 2021/0153544 | A1 | 5/2021 | Sintyureva |
| 2021/0153546 | A1 | 5/2021 | Digard |
| 2021/0169128 | A1 | 6/2021 | Sintyureva et al. |

FOREIGN PATENT DOCUMENTS

| | | | | |
|---|---|---|---|---|
| KR | 10-1397345 | B1 | 5/2014 | |
| KR | 10-1600646 | B1 | 3/2016 | |
| KR | 10-2019-0134789 | A | 12/2019 | |
| KR | 10-2019-0134790 | A | 12/2019 | |
| KR | 10-2019-0134791 | A | 12/2019 | |
| KR | 10-2021-0111224 | A | 9/2021 | |
| WO | 2015/107552 | A1 | 7/2015 | |
| WO | WO-2018210681 | A2 * | 11/2018 | ..... A24B 15/167 |
| WO | 2021/157836 | A1 | 8/2021 | |

OTHER PUBLICATIONS

Extended European Search Report dated May 15, 2024 in Application No. 22813872.3.

* cited by examiner

【Figure 1】
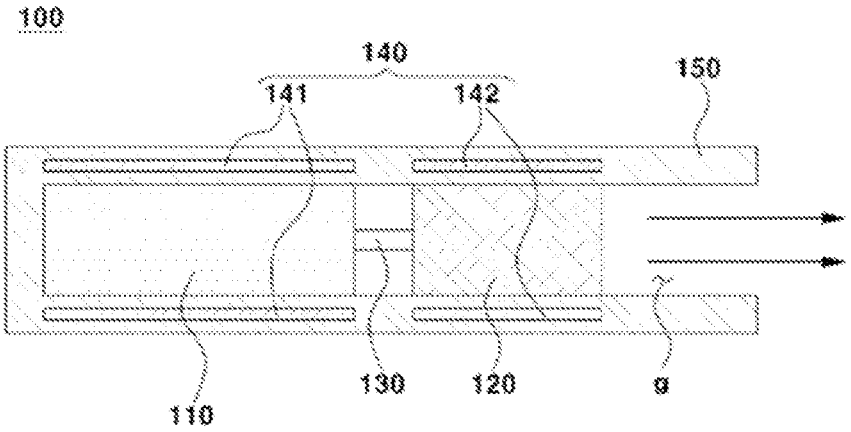
【Figure 2】
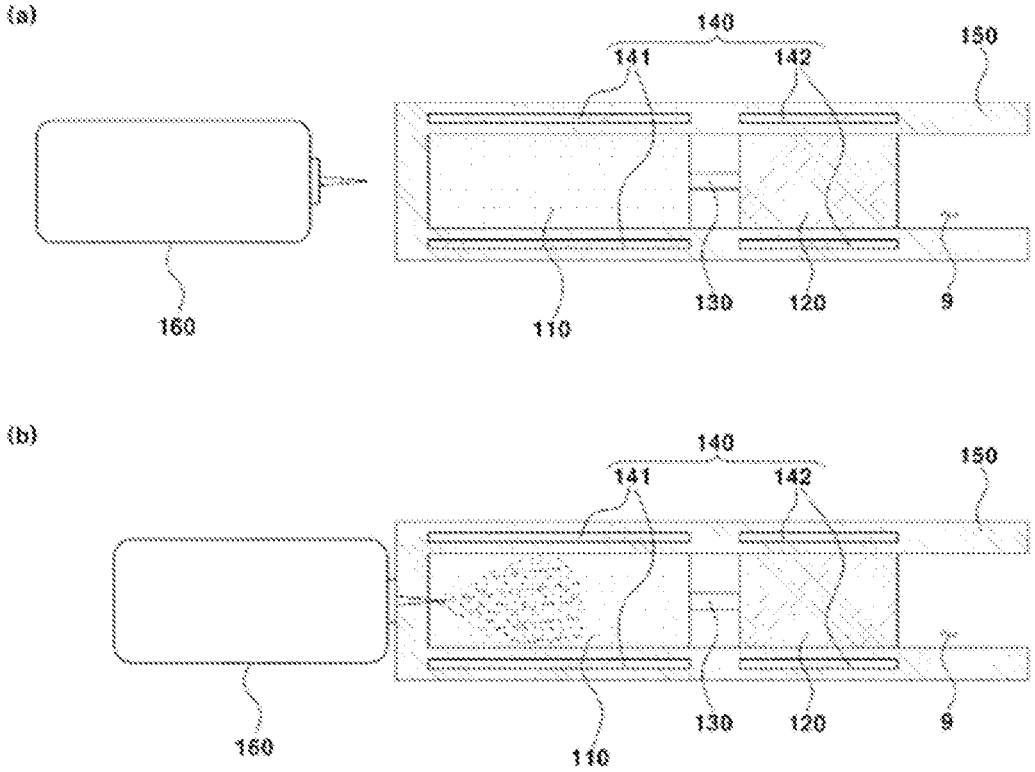

【Figure 3】
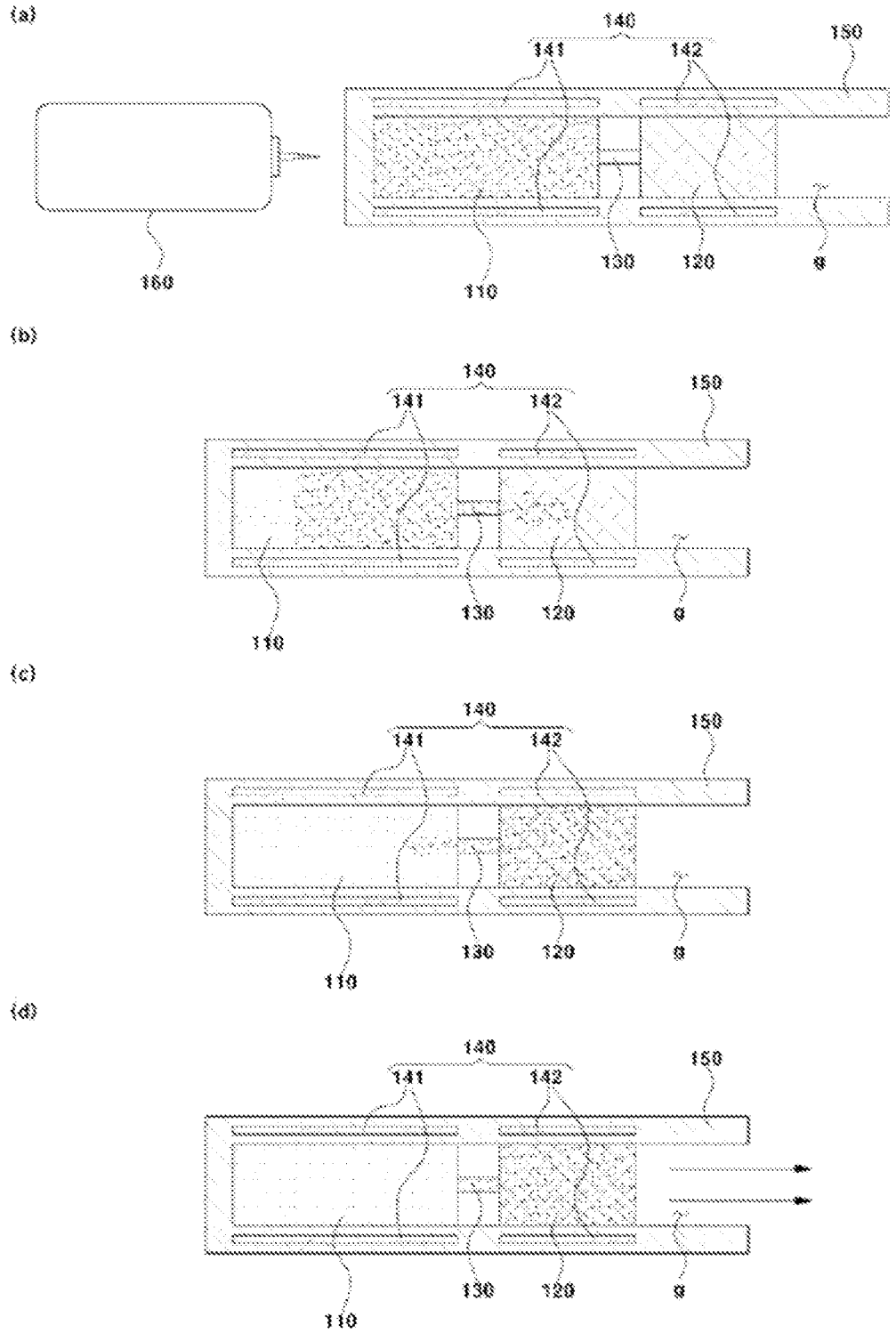

【Figure 4】
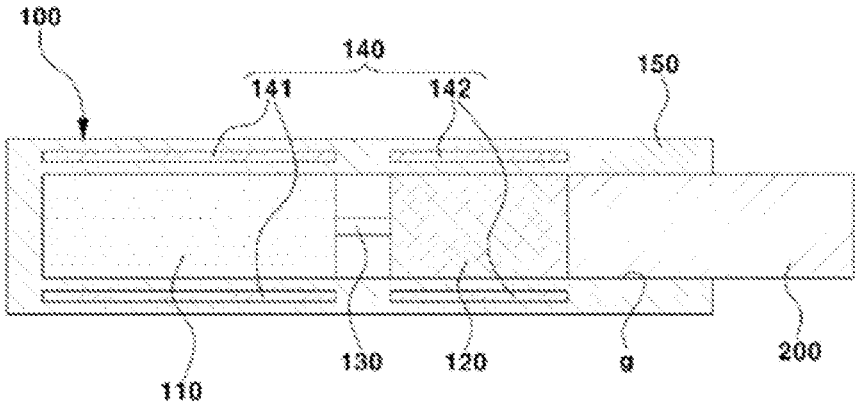

AEROSOL GENERATING APPARATUS

TECHNICAL FIELD

The present disclosure relates to an aerosol generating apparatus. More particularly, the present disclosure relates to an aerosol generating apparatus including a supercritical extraction unit.

This application is a 371 of international Application No. PCT/KR2022/015719 filed on Oct. 17, 2022, which claims the benefit of priority based on Korean Patent Application No. 10-2021-0145686 filed on Oct. 28, 2021, the entire contents of which are incorporated as a part of the present specification by reference.

BACKGROUND ART

Recently, there is an increasing demand for alternative methods that overcome the disadvantages of conventional cigarettes. Specifically, the demand for an electronic cigarette that transfers tobacco components such as nicotine by heating cigarettes rather than burning the cigarettes is gradually increasing.

Meanwhile, supercritical extraction, which extracts a desired extraction component using a supercritical fluid such as carbon dioxide in a supercritical state, is widely used in various fields such as plant science, medicine, food, and cosmetics

PRIOR ART DOCUMENT

Patent Document (Patent Document 1) Korea Patent Laid-open Publication No. 10-2021-0111224 (Sep. 10, 2021)

DISCLOSURE

Technical Problem

The present disclosure provides a novel aerosol generating apparatus including a supercritical extraction unit for supercritical extraction of extract components such as nicotine, tobacco flavor, and perfume from raw materials such as tobacco and spice plants.

In addition, the present disclosure provides an aerosol generating apparatus that does not require a separate perfume manufacturing process and flavoring process. As a result, the present disclosure is to manufacture an eco-friendly aerosol generation apparatus capable of reducing energy used in a perfume manufacturing process to reduce carbon emission.

In addition, the present disclosure provides an aerosol generating apparatus that allows extraction components, such as nicotine, a tobacco flavor, and perfume, from raw materials such as tobacco and aromatic plants, to be extracted and separated directly in the apparatus and then transfers the extraction components together with an aerosol, thereby providing a fresh and natural flavor.

In addition, the present disclosure provides an aerosol generating apparatus capable of simplifying a manufacturing process and minimizing equipment.

Technical Solution

According to a first aspect of the present invention, an aerosol generating apparatus includes a supercritical extraction unit that includes at least one of tobacco and aromatic plant as a raw material and extracts an extraction component from the raw material by a supercritical fluid; a collection unit that collects the extraction component discharged from the supercritical extraction unit as a collection material; an inlet part that is disposed between the supercritical extraction unit and the collection unit and serves as a path through which the extraction component is introduced from the supercritical extraction unit into the collection unit; a heating unit that heats at least one of the supercritical extraction unit and the collection unit, and a body part in which the supercritical extraction unit, the collection unit, the inlet part, and the heating unit are disposed.

In the aerosol generating apparatus, the extraction component may include at least one of nicotine, a tobacco flavor, and perfume.

In the aerosol generating apparatus, the supercritical fluid may include at least one of carbon dioxide, propane, butane, pentane, ethanol, ethylene, fluorinated ethane, fluorinated propane, and fluorinated butane.

In the aerosol generating apparatus, the collected material may include an aerosol generating agent generating an aerosol.

In the aerosol generating apparatus, the aerosol generating agent may include at least one of glycerol and propylene glycol.

In the aerosol generating apparatus, the tobacco may be tobacco powder.

In the aerosol generating apparatus, the heating unit may include a first heating unit that heats the supercritical extraction unit and a second heating unit that heats the collection unit, the first heating unit may operate when the extraction component is extracted by the supercritical fluid, and the second heating unit may operate when the extraction component is collected as the collected material.

In the aerosol generating apparatus, a heating temperature of the first heating unit and the second heating unit may be different from each other.

In the aerosol generating apparatus, the supercritical extraction unit and the collection unit may be separated from the body part and replaced.

The aerosol generating apparatus may further include: a supply unit that may be connected to and separated from the supercritical extraction unit and supplies the supercritical fluid to the supercritical extraction unit.

In the aerosol generating apparatus, the body part may have a groove formed at one end, and the extraction component may be released from the collection unit through the groove while being used.

In the aerosol generating apparatus, the body part may have a groove formed at one end, and the groove may be an area into which an aerosol generating article including the tobacco is inserted.

Advantageous Effects

According to the present disclosure, it is possible to provide a novel aerosol generating apparatus including a supercritical extraction unit for supercritical extraction of extraction components, such as nicotine, a tobacco flavor, and perfume, from raw materials such as aromatic plants.

In addition, according to the present disclosure, it is possible to provide an aerosol generating apparatus that does not require a separate perfume manufacturing process and flavoring process. As a result, it is possible to provide an aerosol generating apparatus that reduces carbon emissions by reducing energy used in a perfume manufacturing process and is manufactured in an eco-friendly manner.

In addition, according to the present disclosure, it is possible to provide an aerosol generating apparatus that allows extraction components, such as nicotine, a tobacco flavor, and perfume, from raw materials such as tobacco and aromatic plants, to be extracted and separated directly in the apparatus and then transferred together with an aerosol, thereby providing a fresh and natural flavor.

In addition, according to the present disclosure, it is possible to provide an aerosol generating apparatus capable of simplifying a manufacturing process and minimizing equipment.

DESCRIPTION OF DRAWINGS

FIG. 1 is a cross-sectional view of an aerosol generating apparatus according to an embodiment of the present invention.

FIG. 2 is a schematic diagram for explaining a process of supplying a supercritical fluid to a supercritical extraction unit of an aerosol generating apparatus according to an embodiment of the present invention.

FIG. 3 is a schematic diagram for explaining a process of extracting, collecting, and discharging an extraction component in the aerosol generating apparatus according to the embodiment of the present invention.

FIG. 4 is a cross-sectional view of a state in which an aerosol generating article is inserted into the aerosol generating apparatus according to the embodiment of the present invention.

BEST MODEL

The embodiments of the present invention will be described in detail with reference to the following description and accompanying drawings. However, examples provided through the following description and accompanying drawings are intended to help understand the present invention, and the embodiments of the present invention are not intended to be limited to the examples. Accordingly, the embodiments should be construed as illustrative and not limiting.

In addition, in the drawings, all or some of the components may be exaggerated or reduced for convenience of description. In addition, some components may be omitted and illustrated.

FIG. 1 is a cross-sectional view of an aerosol generating apparatus according to an embodiment of the present invention.

Referring to FIG. 1, an aerosol generating apparatus 100 includes a supercritical extraction unit 110 that includes at least one of tobacco and aromatic plant as a raw material, and extracts an extraction component from the raw material by a supercritical fluid, a collection unit 120 that collects the extraction component discharged from the supercritical extraction unit as a collection material, an inlet part 130 that is disposed between the supercritical extraction unit 110 and the collection unit 120 and serves as a path through which the extraction component is introduced from the supercritical extraction unit 110 into the collection unit 120, a heating unit 140 that heats at least one of the supercritical extraction unit 110 and the collection unit 120, and a body part 150 in which the supercritical extraction unit 110, the collection unit 120, the inlet part 130, and the heating unit 140 are disposed.

The supercritical extraction unit 110 may be provided with at least one of tobacco and aromatic plants as a raw material, and supplied with a supercritical fluid. Through this, the supercritical extraction unit 110 may extract an extraction component from at least one of the tobacco and the aromatic plants as the raw materials by the supercritical fluid. In this case, the supercritical fluid may be supplied to the supercritical extraction unit 110 from a supply unit 160 to be described later.

A shape of the supercritical extraction unit 110 is not particularly limited, but may be, for example, a cylindrical shape. A diameter of the supercritical extraction unit 110 may be the same as or different from that of the collection unit 120. A material for forming the supercritical extraction unit 110 is not particularly limited, but may be, for example, a thermally conductive material such as stainless steel. When the thermally conductive material is used as the material for forming the supercritical extraction unit 110, sufficient heat may be transferred to the supercritical extraction unit 110 when the thermally conductive material is heated by a first heating unit 141.

For efficient supercritical extraction, the size of the supercritical extraction unit 110 may be larger than that of the collection unit 120. Here, the size may mean volume. However, the size of the supercritical extraction unit 110 may be the same as that of the collection unit 120 or smaller than that of the collection unit 120 without being limited thereto.

The tobacco included in the supercritical extraction unit 110 may be tobacco powder including pulverized tobacco leaves, pulverized tobacco stems, pulverized reconstituted tobacco, and the like. As such, powdered tobacco obtained by pulverizing tobacco leaves, tobacco stems, reconstituted tobacco, and the like may be particularly suitable for use in the small-sized aerosol generating apparatus 100. In addition, the tobacco powder may have a large surface area to increase the efficiency of the supercritical extraction.

As a raw material of the tobacco included in the supercritical extraction unit 110, yellow species, burley species, orient species, sheet leaf, expanded shredded tobacco, expanded tobacco midribs, and the like may be used. In addition, two or more kinds of tobacco raw materials may be mixed and used as raw materials for tobacco. In this case, the content of each of the mixed raw materials of tobacco may be the same as or different from each other.

As the aromatic plants included in the supercritical extraction unit 110, at least one of menthol, chamomile, mint, cinnamon, peppermint, spearmint, lavender, fenugreek, bergamot, salvia, geranium, jasmine, Ylang Ylang, sage, cardamom, cardamom, nutmeg, celery, master, cassia, hydrangea, fennel, anise, licorice, magnolia, cloves, sandalwood, caraway, ginger, coffee, mandarin, lemon, and orange may be used, but the types of aromatic plants are not limited to the above examples, and as the aromatic plants, various materials that may play a flavoring role may be used.

The extraction component extracted by the supercritical extraction unit 110 may include at least one of nicotine, a tobacco flavor, and perfume. For example, when the supercritical extraction unit 110 includes tobacco, tobacco components such as nicotine and tobacco flavor may be extracted as the extraction component from the tobacco by the supercritical fluid. Alternatively, when the supercritical extraction unit 110 includes the aromatic plant, the perfume may be extracted as the supercritical fluid from the aromatic plants as the extraction component. When the supercritical extraction unit 110 includes both the tobacco and aromatic plants, and the perfume and the tobacco components such as nicotine and tobacco flavor may be extracted as the extraction component by the supercritical fluid.

As the supercritical fluid for extracting the extraction component from the supercritical extraction unit 110, the supercritical fluid that may be used for the supercritical extraction may be used without limitation, and may contain at least one of, for example, carbon dioxide, propane, butane, pentane, ethanol, ethylene, and a propellant. In the present specification, the propellant means a material that transports aerosol generated from raw materials such as nicotine, tobacco flavor, and perfume to a user's mouth, and specifically, may include at least one of fluorinated ethane, fluorinated propane, and fluorinated butane. As the fluorinated ethane as the propellant, tetrafluoroethane may be used.

The supercritical fluid is in a state of high pressure and high temperature exceeding a critical temperature and a critical pressure of the supercritical fluid. For example, when carbon dioxide is used as the supercritical fluid, carbon dioxide is supplied to the supercritical extraction unit 110 in a supercritical state in which the carbon dioxide exceeds a critical temperature of the carbon dioxide, that is, about 31° C. and exceeds a critical pressure of the carbon dioxide, that is, about 73 atm, thereby performing the supercritical extraction. As another example, when propane is used as the supercritical fluid, the propane is supplied to the supercritical extraction unit 110 in a supercritical state in which the propane exceeds a critical temperature of the propane, that is, about 97° C. and exceeds a critical pressure of the propane, that is, about 42 atm, thereby performing the supercritical extraction. As another example, when n-butane is used as the supercritical fluid, the butane is supplied to the supercritical extraction unit 110 in a supercritical state in which the butane exceeds a critical temperature of the butane, that is, about 152° C. and exceeds a critical pressure of the butane, that is, about 38 atm, thereby performing the supercritical extraction.

A collected material is disposed in the collection unit 120, and the extraction component discharged from the supercritical extraction unit 110 is introduced into the collection unit 120. The introduced extraction component may be collected as a collected material by the collection unit 120.

In this case, the extraction component discharged from the supercritical extraction unit 110 may be introduced into the collection unit 120 together with the fluid used as the supercritical fluid. In this case, the extraction component in the collection unit 120 may be transferred from the fluid used as the supercritical fluid to the collected material. The fluid used as the supercritical fluid may exist in the supercritical state even in the collection unit 120, but unlike the supercritical extraction unit 110, may exist in the collection unit 120 in a non-supercritical state.

The shape of the collection unit 120 is not particularly limited, but may be, for example, a cylindrical shape. The diameter of the collection unit 120 may be the same as or different from that of the collection unit 120. The material for forming the supercritical extraction unit 120 is not also particularly limited, but may be, for example, a thermally conductive material such as stainless steel. When the thermally conductive material is used as the material for forming the collection unit 120, sufficient heat may be transferred to the supercritical extraction unit 120 when the thermally conductive material is heated by a second heating unit 142.

The collected material may include an aerosol generating agent capable of generating an aerosol. The aerosol generating agent may include at least one of glycerol and propylene glycol, but is not limited thereto. The collected material may be impregnated in a filter tow such as acetate tow and disposed in the collection unit 120 together with the filter tow.

The inlet part 130 is disposed between the supercritical extraction unit 110 and the collection unit 120, and serves as a path through which the extraction component is introduced from the supercritical extraction unit 110 into the collection unit 120 by connecting the supercritical extraction unit 110 and the collection unit 120.

As described above, the extraction component discharged from the supercritical extraction unit 110 may be introduced into the collection unit 120 together with the fluid used as the supercritical fluid. In this case, the extraction component discharged from the supercritical extraction unit 110 may be introduced from the supercritical extraction unit 110 into the collection unit 120 through the inlet part 130 together with the fluid used as the supercritical fluid. The fluid used as the supercritical fluid may exist in the supercritical state even in the inlet part 130, but unlike the supercritical extraction unit 110, may exist in the collection unit 120 in the non-supercritical state.

The inlet part 130 may include a gate that may be opened and closed. When the gate is opened, the supercritical extraction unit 110 and the collection unit 120 may be connected to each other, and when closed, the supercritical extraction unit 110 and the collection unit 120 may be disconnected from each other. Accordingly, when the gate is opened, the extraction component may be introduced from the supercritical extraction unit 110 into the collection unit 120 together with the fluid used as the supercritical fluid. In addition, the gate may be closed before and/or after the extraction component is introduced from the supercritical extraction unit 110 into the collection unit 120 together with the fluid used as the supercritical fluid.

The inlet part 130 may serve as a path through which the extraction component is introduced from the supercritical extraction unit 110 into the collection unit 120 together with the fluid used as the supercritical fluid by the pressure of the supercritical fluid. In this case, as described above, when the inlet part 130 includes a gate, the inlet part 130 may serve as a path through which the extraction component is introduced from the supercritical extraction unit 110 into the collection unit 120 together with the fluid used as the supercritical when the gate is opened by the pressure of the supercritical fluid. However, the present disclosure is not limited thereto. Even when the inlet part 130 does not include the gate, the inlet part 130 may serve as a path through which the extraction component is introduced from the supercritical extraction unit 110 into the collection unit 120 together with the fluid used as the supercritical fluid by the pressure difference between the supercritical extraction unit 110 and the collection unit 120 As another example, the inlet part 130 may serve as a path through which the extraction component is introduced from the supercritical extraction unit 110 into the collection unit 120 together with the fluid used as the supercritical fluid when the gate is opened by a control unit (not illustrated).

The shape of the inlet part 130 is not particularly limited, but may be, for example, a cylindrical shape. The diameter of the inlet part 130 may be smaller than diameters of each of the supercritical extraction unit 110 and the collection unit 120. The material for forming the inlet part 130 is not particularly limited, but may be, for example, plastic or metal.

The heating unit 140 heats at least one of the supercritical extraction unit 110 and the collection unit 120. This is because the supercritical extraction unit 110 may require heating during the supercritical extraction, and the collection unit 120 may require heating to generate an aerosol.

At least a portion of the heating part 140 may be embedded in the body part 150. For example, as illustrated in FIG. 1, the heating unit 140 may be completely embedded in the body part 150, whereas unlike only a portion of the heating unit 140 may be embedded in the body part 150 and exposed to an inner surface of the body part 150. However, the heating part 140 may be disposed on the inner surface of the body part 150 and surrounded by the body part 150 without being limited thereto.

The heating unit 140 may include a first heating unit 141 that heats the supercritical extraction unit 110 and a second heating unit 142 that heats the collection unit 120. The first heating unit 141 may operate when the extraction component is extracted by supercritical fluid, and the second heating unit 142 may operate when the extraction component is collected as a collected material. That is, the operating time of the first heating unit 141 and the second heating unit 142 may be different from each other. In addition, the heating temperature of the first heating unit 141 and the second heating unit 142 may be different from each other. As described above, the supercritical extraction unit 110 may require heating during the supercritical extraction, and the collection unit 120 may require heating to generate an aerosol. This is because the heating temperature required for the supercritical extraction may be different from the heating temperature required for the aerosol generation. To this end, the operating time, temperature, etc., of the first heating unit 141 and the second heating unit 142 may be separately controlled.

For the efficient supercritical extraction, the heating temperature of the first heating unit 141 may be 20° C. to 300° C.

For the efficient aerosol generation, the heating temperature of the second heating unit 142 may be 200° C. to 300° C.

The first heating unit 141 may be disposed in a form surrounding an area between one end and the other end of the supercritical extraction unit 110. Similarly, the second heating unit 142 may be disposed in a form surrounding an area between one end and the other end of the collection unit 120. The first heating unit 141 and the second heating unit 142 may be disposed apart from each other by a predetermined distance, but may also be disposed adjacent to each other. However, depending on the design, the heating unit 140 may be configured as a single heating unit for heating at least one of the supercritical extraction unit 110 and the collection unit 120.

The body part 150 may form the appearance of the aerosol generating apparatus 100 and may have a groove g formed at one end thereof. The supercritical extraction unit 110, the collection unit 120, the inlet part 130, and the heating unit 140 are disposed inside the body part 150. Here, being disposed inside the body part 150 means including both those at least partially embedded in the body part 150 and those disposed inside the body part 150 and surrounded by the body part 150.

During use, the extraction component extracted from the supercritical extraction unit 110 and introduced into the collection unit 120 may be discharged from the collection unit 120 through the groove g. In FIG. 1, the extraction component may be discharged in the right direction of the collection unit 120, which is a direction indicated by an arrow. Accordingly, a user inhales one end of the aerosol generating apparatus 100 where the groove g is formed through his and her mouth, and thus may inhale the extraction components such as nicotine, tobacco flavor, and perfume discharged through the groove g.

As described above, when the supercritical extraction unit 110 includes tobacco, the tobacco components such as nicotine and tobacco flavor may be extracted from the tobacco as the supercritical fluid as the extraction component, and during use, the extracted tobacco components may be transferred to the user side together with the aerosol generated in the collection unit 120. In this case, the supercritical extraction unit 110 may further include the aromatic plants in addition to the tobacco, and therefore, the perfume may be extracted as a supercritical fluid from an aromatic plant together with the tobacco components. Through this, it is possible to improve the tobacco flavor. However, the supercritical extraction unit 110 may include an aromatic plant and may not include tobacco. Therefore, the perfume may be extracted as a supercritical fluid from an aromatic plant as the extraction component, and the tobacco components may not be extracted.

Alternatively, the groove g may be an area into which an aerosol generating article including tobacco is inserted. In this case, the supercritical extraction unit 110 may include an aromatic plant, and the extraction component supercritically extracted from the aromatic plant may be perfume. In other words, the supercritical extraction unit 110 with the aromatic plant may extract, as the supercritical fluid, the perfume from the aromatic plant as the extraction component. Accordingly, the perfume introduced into the collection unit 120 through the inlet part 130 is collected as a collected material and delivered to the aerosol generating article inserted into the groove g together with the aerosol generated in the collection unit 120, thereby improving the smoking flavor of the tobacco. However, it is not necessarily limited thereto. For example, the supercritical extraction unit 110 further includes tobacco in addition to the aromatic plant as needed, and may extract the tobacco components such as nicotine and tobacco flavor from tobacco as the supercritical fluid together with the perfume as the extraction component.

However, the aerosol generating apparatus 100 according to the embodiment of the present invention does not necessarily need to be used together with the aerosol generating article. For example, when the supercritical extraction unit 110 includes tobacco, it is possible to provide tobacco components such as nicotine and tobacco flavor to the user only with the aerosol generating apparatus 100 without a separate aerosol generating article. In other words, when the aerosol generating apparatus 100 includes tobacco, the aerosol generating apparatus 100 may be used alone without being used together with the aerosol generating article. However, it goes without saying that the aerosol generating apparatus 100 may be implemented to be used together with the aerosol generating article according to design.

As described above, in the aerosol generating apparatus 100 according to the embodiment of the present invention, the supercritical extraction unit 110 extracts the nicotine, the tobacco flavor, and/or the perfume from the tobacco and/or the aromatic plant. Accordingly, the aerosol generating apparatus 100 according to the embodiment of the present invention does not require a separate perfume manufacturing process or flavoring process. As a result, it is possible to manufacture an eco-friendly aerosol generation apparatus capable of reducing energy used in a perfume manufacturing process to reduce carbon emission. In addition, fresh and natural flavors may be provided by directly extracting and separating extraction components from raw materials such as tobacco and aromatic plants in the apparatus, and then transferring the extracted and separated extraction components together with an aerosol. In addition, raw materials such as tobacco and aromatic plants may be directly disposed in the supercritical extraction unit 110 with minimal processing, thereby simplifying the manufacturing process and minimizing equipment.

Meanwhile, the supercritical extraction unit 110 and the collection unit 120 may be separated from the body part 150 and replaced. Accordingly, when the supercritical extraction unit 10 already extracts and collects a sufficient amount of extraction components from tobacco and aromatic plants, and thus, the concentration of the extracted and collected extraction components becomes insignificant, the supercritical extraction unit 110 and the collection unit 120 can be separated and replaced with new ones. The supercritical extraction unit 110 and the collection unit 120 may be integrally separated and replaced from the body part 150 or may be separately separated and replaced.

In this case, the inlet part 130 disposed between the supercritical extraction unit 110 and the collection unit 120 may also be separated from the body part 150 and replaced. The inlet part 130 may be integrally separated and replaced from the body part 150 along with the supercritical extraction unit 110 and the collection unit 120, but may also be separately separated and replaced. The supercritical extraction unit 110, the collection unit 120, and the inlet part 130 may have a structure connected to each other for separation and replacement integrally, but are not necessarily limited thereto.

Meanwhile, as described later in the description of FIG. 2, the aerosol generating apparatus 100 according to the embodiment of the present invention may further include a supply unit 160 that may be connected to and separated from the supercritical extraction unit 110, and supplies the supercritical fluid to the supercritical extraction unit. Specifically, the supply unit 160 may include a supercritical fluid, and the supercritical fluid may be supplied from the supply unit 160 to the supercritical extraction unit 110 to extract the extraction components.

However, the aerosol generating apparatus 100 according to the embodiment of the present invention does not include only the above components, and may further include other components generally used in the aerosol generating apparatus. For example, the aerosol generating apparatus 100 according to the embodiment of the present invention may further include components such as a battery and a control unit.

FIG. 2 is a schematic diagram for explaining a process of supplying a supercritical fluid to a supercritical extraction unit of an aerosol generating apparatus according to an embodiment of the present invention.

FIG. 3 is a schematic diagram for explaining a process of extracting, collecting, and discharging an extraction component in the aerosol generating apparatus according to the embodiment of the present invention.

Referring to FIG. 2, the supply unit 160 containing a supercritical fluid is connected to the supercritical extraction unit 110. Through this, the supercritical fluid of the supply unit 160 is supplied to the supercritical extraction unit 110.

Next, referring to FIG. 3A, the supply unit 160 is separated from the supercritical extraction unit 110. In addition, in the supercritical extraction unit 110, the extraction component from the raw material including at least one of tobacco and aromatic plant is extracted by the supercritical fluid. In this case, in order to improve the supercritical extraction efficiency of the extraction component, the supercritical extraction unit 110 may be heated by the first heating unit 141.

Next, referring to FIG. 3B, the extraction component is discharged from the supercritical extraction unit 110 and introduced into the collection unit 120 through the inlet part 130. In this case, the extraction component discharged from the supercritical extraction unit 110 may be introduced into the collection unit 120 together with the fluid used as the supercritical fluid.

As described above, the inlet part 130 may serve as the path through which the extraction component is introduced from the supercritical extraction unit 110 into the collection unit 120 together with the fluid used as the supercritical fluid by the pressure of the supercritical fluid. As another example, the inlet part 130 may serve as the path through which the extraction component is introduced from the supercritical extraction unit 110 into the collection unit 120 together with the fluid used as the supercritical fluid by the control unit (not illustrated).

Next, referring to FIG. 3C, the extraction component discharged from the supercritical extraction unit 110 is collected as a collected material by the collection unit 120. When the extraction component from the supercritical extraction unit 110 is introduced into the collection unit 120 together with the fluid used as the supercritical fluid, the extraction component in the collection unit 120 may be delivered as the collected material from the fluid used as the supercritical fluid.

Next, referring to FIG. 3D, the extraction component is transferred together with the aerosol generated in the collection unit 120. In this case, in order to generate an aerosol, the collection unit 120 may be heated by the second heating unit 142. Accordingly, a user inhales one end of the aerosol generating apparatus 100 where the groove g is formed through his and her mouth, and thus may inhale the extraction components, such as nicotine, tobacco flavor, and perfume, discharged through the grooves g together with the aerosol.

FIG. 4 is a cross-sectional view of a state in which an aerosol generating article is inserted into the aerosol generating apparatus according to the embodiment of the present invention.

Referring to FIG. 4, an aerosol generating article 200 may be coupled to the aerosol generating apparatus 100, and may be specifically inserted into the groove g of the aerosol generating apparatus 100.

The aerosol generating article 200 includes a tobacco charging unit containing tobacco. In addition, the aerosol generating article 200 may further include other general-purpose components of the aerosol generating article 200, such as a filter unit, a cooling unit, and a mouthpiece unit.

FIG. 4 illustrates that the aerosol generating article 200 is disposed adjacent to the collection unit 120, but may be disposed apart from the collection unit 120 by a predetermined distance.

As described above, the supercritical extraction unit 110 may include an aromatic plant, and the extraction component extracted from the aromatic plant may be perfume. In other words, the supercritical extraction unit 110 with the aromatic plant may extract, as the supercritical fluid, the perfume from the aromatic plant as the extraction component. Accordingly, the perfume introduced into the collection unit 120 through the inlet part 130 is collected as a collected material and delivered to the aerosol generating article 200 inserted into the groove g together with the aerosol generated in the collection unit 120, thereby improving the smoking flavor of the tobacco.

Although the embodiments of the present invention have been described above by way of example, the above description is intended to help understanding of the present invention, and is not intended to limit the embodiments of the present invention to the above-described form. Accordingly, the embodiments should be construed as illustrative and not limiting.

In addition, the scope of the present invention should be defined by the claims below and should not be limited to the examples. Those skilled in the art will be able to implement the present invention in various forms without departing from the technical idea of the present invention with reference to this specification and the accompanying drawings. Therefore, technical ideas within the scope equivalent or equivalent to the appended claims should be construed as being included in the scope of the present invention.

The terms and expressions used herein are to be interpreted broadly and not in a limiting sense. Unless defined otherwise, all terms and expressions used in this specification may be interpreted as meanings commonly understood by those of ordinary skill in the art to which the present invention belongs. The expression "including" in this specification does not exclude the presence or addition of one or more other components other than the mentioned components.

In this specification, the order of first, second, etc., is for distinguishing components from each other, and does not mean a priority order between components or an absolute order. Accordingly, a component referred to as a first component in some parts of this specification may be referred to as a second component in other parts of this specification.

Unless otherwise stated, numerical ranges given herein are meant to be inclusive of boundary values. For example, the expression 1 to 10 may mean 1 or more and 10 or less, which is a range including 1 and 10.

In this specification, expressions in the singular form include plural forms unless explicitly excluded from context.

Each embodiment described as an example in this specification can be combined with each other, and unless contradictory, contents described in a specific embodiment can be equally applied to other embodiments even if not described in other embodiments.

DETAILED DESCRIPTION OF MAIN ELEMENTS

100: Aerosol generating apparatus
110: Supercritical extraction unit
120: Collection unit
130: Inlet part
140: Heating unit
141: First heating unit
142: Second heating unit
150: Body part
160: Supply unit
200: Aerosol generating article

The invention claimed is:

1. An aerosol generating apparatus, comprising:

a supercritical extraction unit that includes at least one of tobacco and aromatic plant as a raw material, and is configured to extract an extraction component from the raw material by a supercritical fluid;

a collection unit configured to collect the extraction component discharged from the supercritical extraction unit as a collection material;

an inlet part that is disposed between the supercritical extraction unit and the collection unit and serves as a path through which the extraction component is introduced from the supercritical extraction unit into the collection unit;

a heating unit comprising:

a first heating unit configured to heat the supercritical extraction unit based on the extraction component being extracted from the raw material, and a second heating unit configured to heat the collection unit to generate aerosol; and a body part in which the supercritical extraction unit, the collection unit, the inlet part, and the heating unit are disposed, wherein the body part includes a groove formed at one end and configured to discharge the aerosol therethrough, wherein the supercritical extraction unit, the collection unit, and the inlet part are separable from the body part and are replaceable, and wherein the inlet part includes a gate configured to open and close in response to a supply of the supercritical fluid.

2. The aerosol generating apparatus of claim 1, wherein the extraction component includes at least one of nicotine, a tobacco flavor, and perfume.

3. The aerosol generating apparatus of claim 1, wherein the supercritical fluid includes at least one of carbon dioxide, propane, butane, pentane, ethanol, ethylene, fluorinated ethane, fluorinated propane, and fluorinated butane.

4. The aerosol generating apparatus of claim 1, wherein the collection material includes an aerosol generating agent configured to generate the aerosol.

5. The aerosol generating apparatus of claim 4, wherein the aerosol generating agent includes at least one of glycerol and propylene glycol.

6. The aerosol generating apparatus of claim 1, wherein the tobacco is tobacco powder.

7. The aerosol generating apparatus of claim 1, wherein the first heating unit is configured to operate when the extraction component is extracted by the supercritical fluid, and wherein the second heating unit is configured to operate when the extraction component is collected as the collection material.

8. The aerosol generating apparatus of claim 7, wherein a heating temperature of the first heating unit and the second heating unit are different from each other.

9. The aerosol generating apparatus of claim 1, further comprising:

a supply unit that is connectable to and separable from the supercritical extraction unit and is configured to supply the supercritical fluid to the supercritical extraction unit.

10. The aerosol generating apparatus of claim 1, wherein the groove is an area configured to receive an aerosol generating article including the tobacco.

11. The aerosol generating apparatus of claim 1, wherein the collection unit is configured to release the aerosol to be discharged based on an inhalation by a user.

12. The aerosol generating apparatus of claim 11, wherein the supercritical extraction unit is disposed in the body part at a second end opposite to the one end at which the groove is formed.

13. The aerosol generating apparatus of claim 12, wherein the gate is configured to selectively open and close a connection between the collection unit and the supercritical extraction unit.

* * * * *